US005635802A

United States Patent [19]

Gielen

[11] Patent Number: 5,635,802

[45] Date of Patent: Jun. 3, 1997

[54] LIGHTING UNIT HAVING ELECTRODELESS LOW-PRESSURE DISCHARGE LAMP WITH A LUMINESCENT LAYER

[75] Inventor: Herman J. G. Gielen, Eindhoven, Netherlands

[73] Assignee: U.S. Philips Corporation, New York, N.Y.

[21] Appl. No.: 539,922

[22] Filed: Oct. 6, 1995

[30] Foreign Application Priority Data

Oct. 19, 1994 [EP] European Pat. Off. ..... 94203037

[51] Int. Cl.[6] ..... H05B 41/16

[52] U.S. Cl. ..... 315/248; 315/267; 315/344; 313/493

[58] Field of Search ..... 315/267, 248, 315/344, 338; 313/161, 493, 485, 635, 573, 153

[56] References Cited

U.S. PATENT DOCUMENTS 4,362,967 12/1982 Littwin et al. ..... 313/493

4,710,678 12/1987 Houkes et al. ..... 315/39

5,465,028 11/1995 Antonis et al. ..... 315/248

*Primary Examiner*—Robert Pascal

*Assistant Examiner*—David Vu

*Attorney, Agent, or Firm*—Walter M. Egbert

[57] ABSTRACT

A lighting unit according to the invention comprises an electrodeless low-pressure discharge lamp 20 provided with a discharge vessel 20 enclosing a discharge space 20 with an ionizable filling in a gastight manner. The discharge vessel 20 has a recessed portion 23 and an enveloping portion 23 which transmits radiation generated in the discharge vessel. Means are present in the recessed portion for initiating and maintaining an electric discharge in the discharge space. The means comprise a member for generating an electric field in the discharge space. The recessed portion is provided with a luminescent layer, which is subdivided into mutually separated regions, at a surface facing the discharge space. The lighting unit further comprises a supply unit for supplying the means. The lamp of the lighting unit according to the invention has a comparatively low ignition voltage.

17 Claims, 5 Drawing Sheets

LIGHTING UNIT HAVING ELECTRODELESS LOW-PRESSURE DISCHARGE LAMP WITH A LUMINESCENT LAYER

BACKGROUND OF THE INVENTION

The invention relates to a lighting unit comprising an electrodeless low-pressure discharge lamp provided with a discharge vessel which encloses a discharge space containing an ionizable filling in a gastight manner and which has a recessed potion and an enveloping portion which is permeable to radiation generated in the discharge vessel, while the recessed portion is provided with a luminescent layer at a surface facing towards the discharge space and means are present in the recessed portion for achieving and maintaining an electric discharge in the discharge space, which means comprise a member for generating an electric field in the discharge space, and the lighting unit in addition has a supply unit for supplying said means.

The invention also relates to an electrodeless low-pressure discharge lamp for use in the lighting unit.

The invention also relates to a discharge vessel for use in the lighting unit.

The term "electrodeless low-pressure discharge lamp", also referred to as lamp hereinafter, in the present description and claims is understood to mean a low-pressure discharge lamp in which electrodes in the discharge space are absent. It is possible, however, for electrodes to be present outside the discharge space.

A lighting unit as described above is known from U.S. Pat. No. 4,710,678. In the known lighting unit, a supply unit is accommodated in a housing fastened to the discharge vessel of the lamp. The discharge vessel is entirely coated with a luminescent layer at a surface facing towards the discharge space and is provided with a filling comprising mercury. A coil having a primary winding and a secondary winding around a core of soft magnetic material forms means for achieving and maintaining an electric discharge. When the lighting unit is switched on, an ignition voltage is applied across the primary winding of the coil so as to generate an electric field which initiates a discharge. The magnetic field of the coil maintains the discharge during nominal operation. Electromagnetic interference in the surroundings and in the power mains is counteracted by the secondary winding.

A disadvantage of the known lighting unit is that a comparatively high ignition voltage is required for starting a discharge, especially when the unit has been out of operation for a comparatively long time. The requirements to be imposed on the supply unit and the electrical insulation of lamp components are accordingly comparatively high.

SUMMARY OF THE INVENTION

It is an object of the invention to provide a lighting unit of the kind described in the opening paragraph which ignites comparatively readily and which is of a simple construction.

According to the invention, the lighting unit is for this purpose characterized in that the luminescent layer on the recessed portion is subdivided into mutually separated regions. Surprisingly, a comparatively low ignition voltage can suffice in the lighting unit according to the invention. A possible explanation is the following: the moment the lighting unit is switched off, positive charge carders such as ionized filling ingredients and negative charge carders such as electrons are present on the luminescent layer after colliding against this layer from the discharge space. Owing to the electric fields prevalent in the discharge space, the positive and the negative charge carders are not equally distributed over the luminescent layer on the recessed portion. Some regions of the luminescent layer thus have predominantly positive charge carriers, other regions have predominantly a negative charge. Since the regions are mutually separated in the lighting unit according to the invention, recombination of positively and negatively charged particles between regions is strongly hampered. Thus a resultant charge remains on the luminescent layer for a longer period.

Upon ignition of the lamp, the charge carriers present on the luminescent layer are freed comparatively easily under the influence of the electric fields prevalent in the discharge space and form a source of primary electrons. The ignition voltage may thus be comparatively low. The measure according to the invention does not require additional components.

An attractive embodiment is characterized in that the means comprise a coil which is provided with a winding of an electrical conductor. During operation, the coil generates both an electric field which can initiate a discharge and creates a wall charge during operation, and a magnetic field which keeps the discharge going.

In a practical embodiment, the coil comprises a winding curved in the shape of a torus portion, for example around an annular core of soft magnetic material, while each of the ends of the winding is directed at an individual region of the luminescent layer.

Very favorable results were obtained with an embodiment of the lamp according to the invention which is characterized in that the winding is a helix with a longitudinal axis, regions of the luminescent layer being arranged in the direction of said longitudinal axis. The winding may be provided, for example, around a core of soft magnetic material. Alternatively, a core may be absent.

An attractive embodiment is characterized in that the member comprises a first and a second electrode which extend each adjacent a respective region of the luminescent layer. The electrodes are capable of generating an electric field which initiates and maintains an electric discharge. It is possible to increase the electric field strength further by means of the electrodes in lamps in which the means in addition comprise a coil, so that not only a greater wall charge remains upon switching-off of the lighting unit, but this charge is also freed more easily upon switching-on.

The supply of a lighting unit according to the invention is accommodated, for example, in a housing fastened to the discharge vessel and also supporting a lamp cap. Such a lighting unit is suitable for replacing an incandescent lamp. In a modification, the discharge vessel is detachably fastened to the housing, so that the former can be replaced with another discharge vessel according to the invention, for example a discharge vessel radiating light of a different colour temperature during operation. Alternatively, a lighting unit according to the invention may be formed, for example, by an assembly of an electrodeless low-pressure discharge lamp according to the invention and a supply unit, wherein the lamp can be connected to the supply unit, for example, via coax cable These and other aspects will be explained in more detail with reference to the drawings, in which:

DESCRIPTION OF THE PREFERRED EMBODIMENTS

Figure 1:
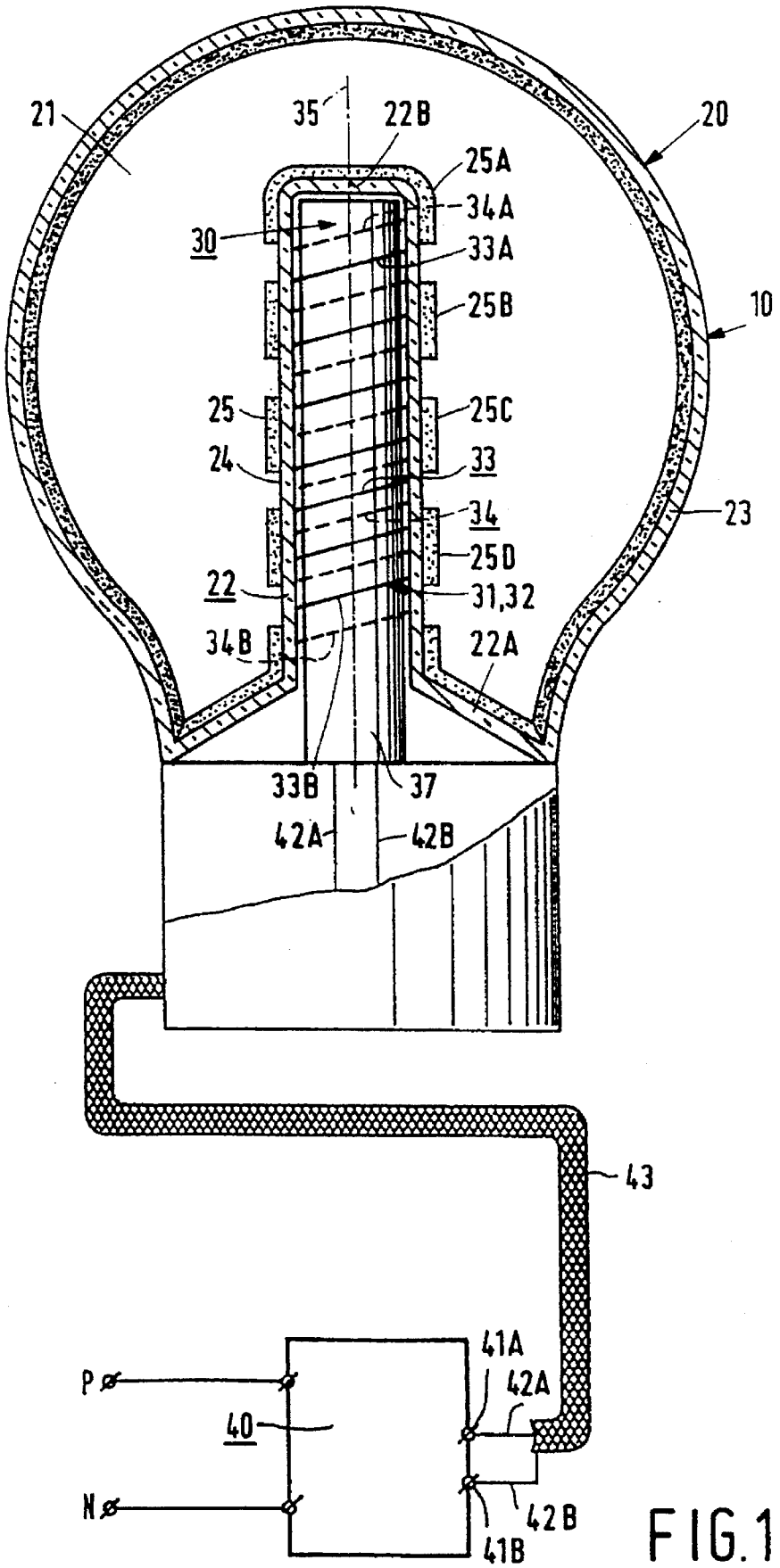
FIG. 1 shows a first embodiment of the lighting unit, partly in elevation and partly in longitudinal sectional view, the supply unit being shown diagrammatically.

The lighting unit shown in FIG. 1 comprises an electrodeless low-pressure discharge lamp 10 which is provided with a discharge vessel 20 enclosing a discharge space 21, which contains an ionizable filling, in a gastight manner. The filling here comprises mercury and argon with a filling pressure of 33 Pa. The mercury vapour pressure is stabilized during nominal operation by means of a main amalgam of mercury with an alloy of bismuth and indium. In addition, an auxiliary amalgam of mercury with indium is present in the discharge vessel 20. Alternatively, the discharge space 21 may comprise, for example, exclusively a rare gas such as xenon. The discharge vessel 20 has a tubular recessed portion 22 which is connected at a widened end 22A to an enveloping portion 23. The enveloping portion 23 is permeable to radiation generated in the discharge vessel 20. Means 30 are present in the recessed portion 22 for initiating and maintaining an electric discharge in the discharge space 21. The means 30 comprise a member 31 for generating an electric field in the discharge space 21. The entire surface area 24 of the discharge vessel 20 facing towards the discharge space 21 is provided with a luminescent layer 25, which is composed of 80% yttrium oxide activated by trivalent europium and 20% cerium-magnesium aluminate with trivalent terbium as the activator. The lighting unit in addition comprises a supply unit 40 for supplying the means 30.

The luminescent layer 25 on the recessed portion 22 is subdivided into mutually separated regions 25A–25D. The coating weight of the luminescent layer 25 in said regions 25A–25D is 7 mg/cm$^2$.

In the embodiment shown, the means 30 comprise a coil 32 which is provided with a winding 33 of an electrical conductor (called primary winding hereinafter). The coil 32 at the same time forms a member 31 for generating an electric field in the discharge space 21. The primary winding 33 in this case is a helix with a longitudinal axis 35, while regions 25A–25D of the luminescent layer 25 are arranged in the direction of the longitudinal axis 35. The regions 25A–25D each have a length of 1 cm and are mutually separated by interspacings of 0.5 cm. The ends 33A, 33B of the primary winding 33 are connected to a first and a second output terminal 41A, 41B of the supply 40 via a first and a second current supply conductor 42A, 42B which form a core and a sheath of a coax cable 43, respectively. A high-frequency voltage is present between the output terminals 41A, 41B during operation, the second output terminal 441B being free from high-frequency voltage variations relative to earth. The coil 32 is in addition provided with a secondary winding 34 (shown in broken lines in the Figure) whose first end 34A is connected to the second output terminal 41B of the supply 40, and which has a second, free end 34B. The supply unit 40 is connected to the mains with input terminals P, N.

Figure 2:
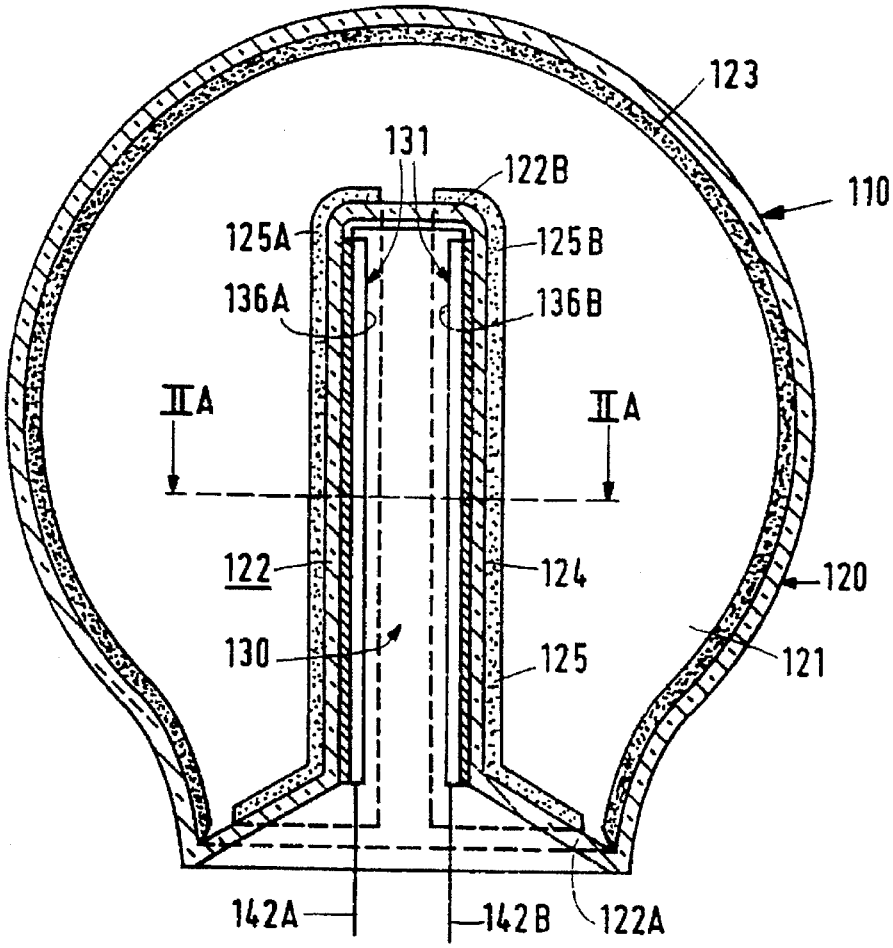
FIG. 2 shows a second embodiment of a lamp in longitudinal sectional view.
Figure 2A:
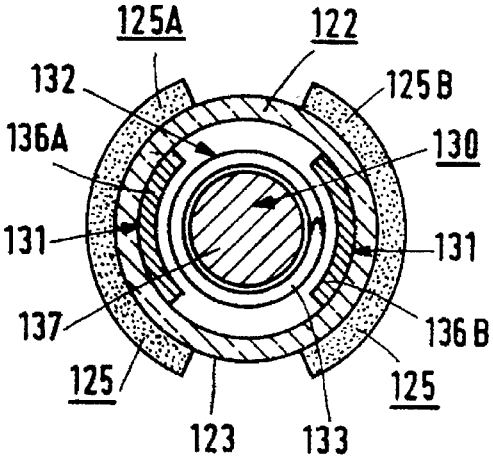
FIG. 2A is a cross-section taken on IIA—IIA in FIG. 2.

In FIGS. 2 and 2A, components corresponding to those from FIG. 1 have reference numerals which are 100 higher. In the embodiment of the lamp 110 according to the invention shown here, a first and a second electrode 136A, 136B each extend within the recessed portion 122 adjacent an associated region 125A, 125B of the luminescent layer 125. In the embodiment shown, the luminescent layer 125 is subdivided into two semicylindrical regions 125A, 125B on the recessed portion 122. Edges of the regions 125A, 125B of the luminescent layer 125 hidden behind the recessed portion 122 have been indicated with broken lines. A high-frequency voltage difference obtains between the electrodes 136A, 136B during operation. The electrodes 136A, 136B in the embodiment shown extend in a direction away from the widened portion 122A to an end 122B remote therefrom. The electrodes 136A, 136B are each connected, for example, to an end of the primary winding 133 of the coil 132. The coil 132 has been shown in FIG. 2A only for the sake of clarity.

Figure 3:
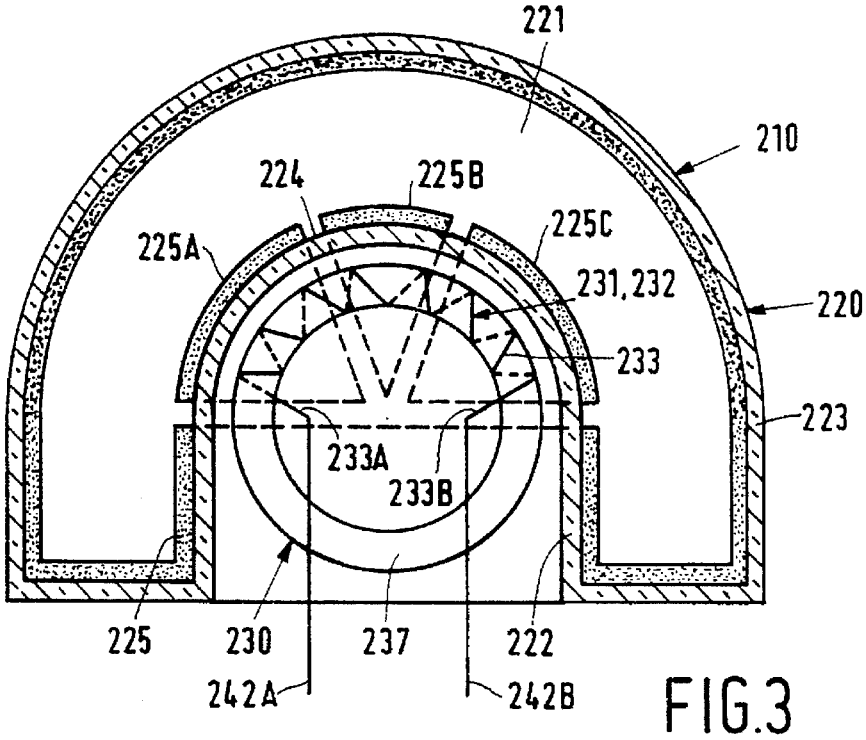
FIG. 3 shows a third embodiment of the lamp, partly in elevation and partly in longitudinal sectional view, FIG. 4 diagrammatically shows a test arrangement in which a fourth embodiment of the lamp is included, FIG. 4A diagrammatically shows the values of two quantities as a function of time.

A further embodiment of the lamp 210 according to the invention is shown in FIG. 3. Components corresponding to those in FIG. 1 have reference numerals here which are 200 higher. In the embodiment of FIG. 3, the coil 232 comprises a winding 233 curved in the shape of a torus portion. The winding 233 is here provided around an annular core 237 of soft magnetic material. Each of the ends 233A, 233B of the winding 233 is directed towards an associated region 225A, 225C of the luminescent layer 225. Edges of regions 225A–225C of the luminescent layer 225 hidden behind the recessed portion 222 are shown in broken lines.

Figure 4A:
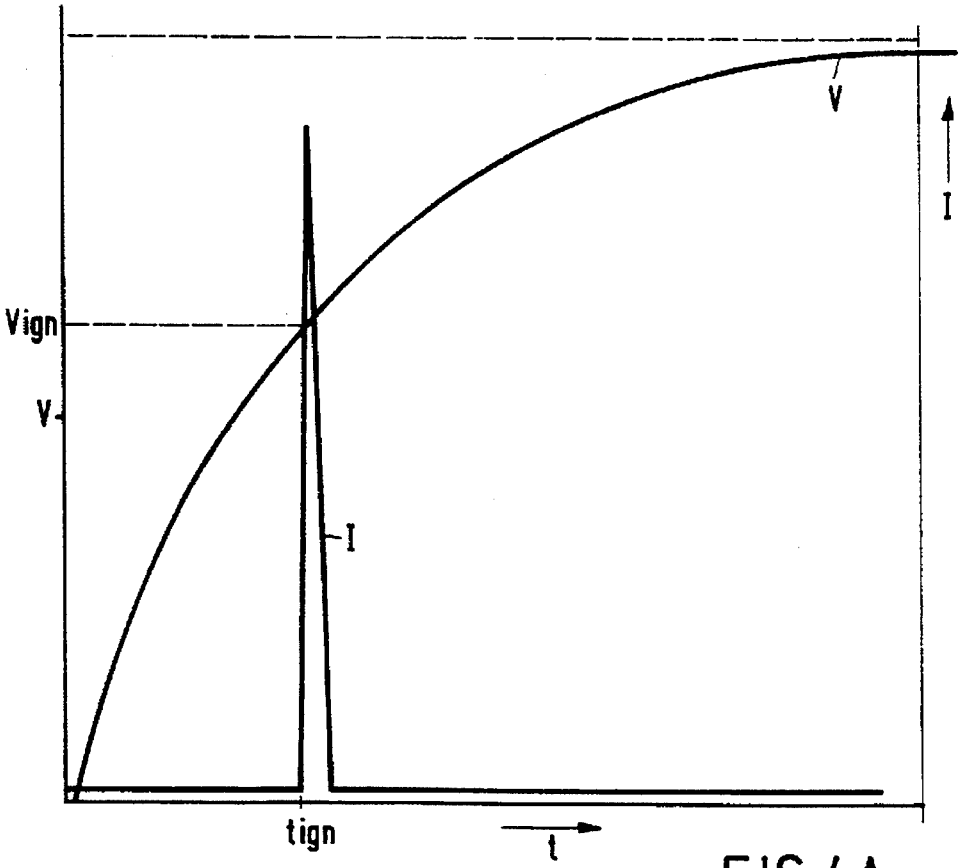
Figure 4:
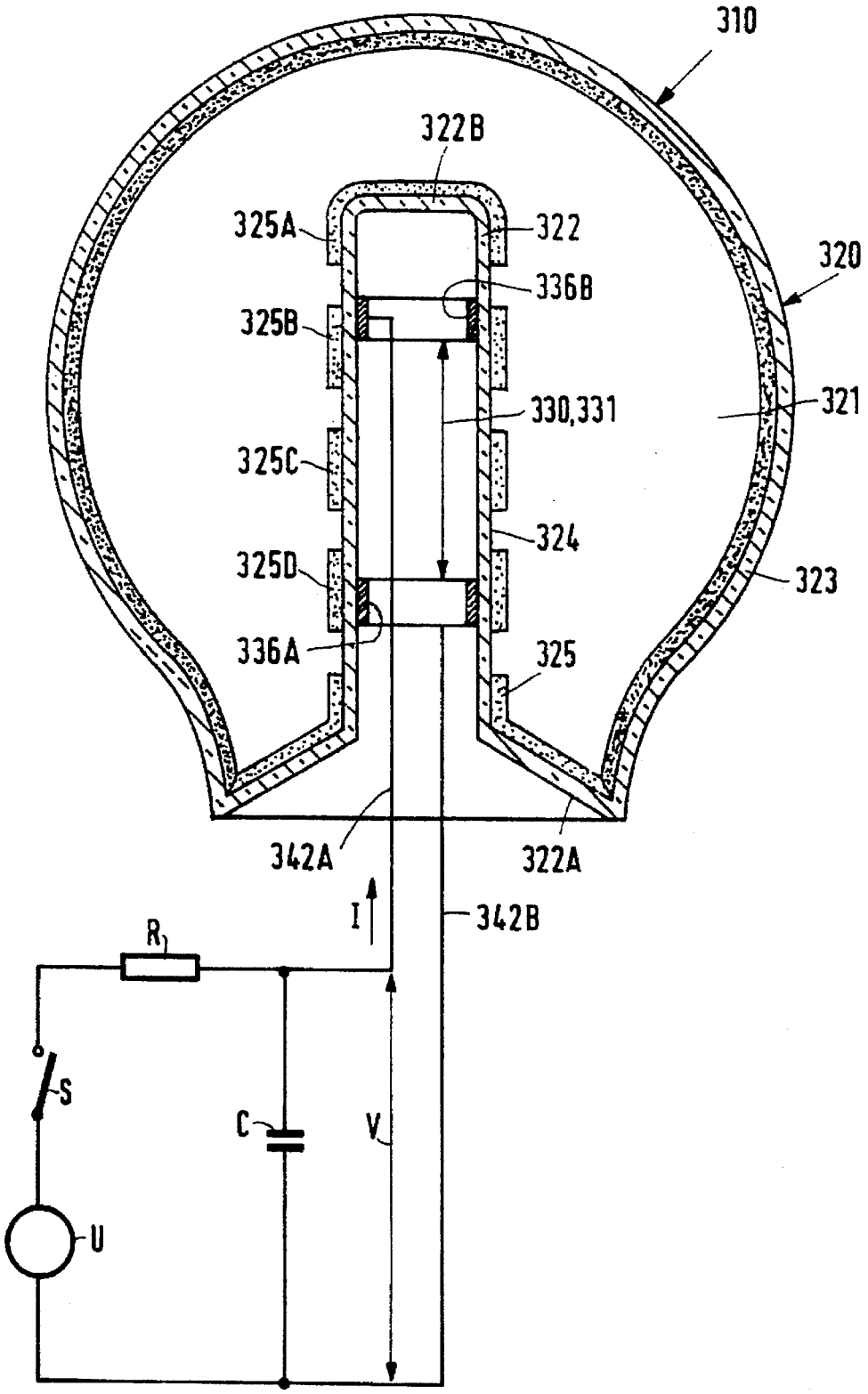

The ignition behaviour of a lamp 310 with a discharge vessel 320 according to the embodiment of FIG. 1 was investigated by means of the test arrangement shown in FIG. 4. In this latter Figure, components corresponding to those of FIG. 1 have reference numerals which are 300 higher. In the test arrangement, a first and a second electrode 336A, 336B are accommodated in the recessed portion 322 of the discharge vessel 320. The electrodes 336A, 336B are constructed as rings with a height of 5 mm, a first one 336A being positioned adjacent the widened end 322A of the recessed portion 322 and a second one 336B adjacent the end 322B remote therefrom. The edges of the first and of the second ring 336A, 336B facing one another have an interspacing of 30 mm. In the presence of a voltage difference across the electrodes 336A, 336B, the latter generate an electric field which is comparable to that of the coil 32 of the lamp of FIG. 1. In the test arrangement shown, a DC voltage source U is connected to the electrodes 336A, 336B via a switch S and a resistor R of 10MΩ. A capacitor C with a capacitance of 5 pF shunts the electrodes 336A, 336B.

Each lamp was placed in a light-proof chamber during the measurement. Before the ignition voltage was measured, the lamps were operated on a supply for 5 minutes and subsequently kept out of operation during a certain period, the dark period ($t_d$). Switch S was closed after the dark period had elapsed. A voltage difference rising in time was created thereby across the capacitor C and the electrodes 336A, 336B. The voltage V across and the current I to the electrodes 336A, 336B were measured as a function of the time elapsed after closing of the switch S (see FIG. 4A). The ignition voltage ($V_{ign}$) is the voltage across the electrodes 336A, 336B the moment a pulsatory change in the current took place as a result of breakdown in the discharge space 321.

Figure 5:
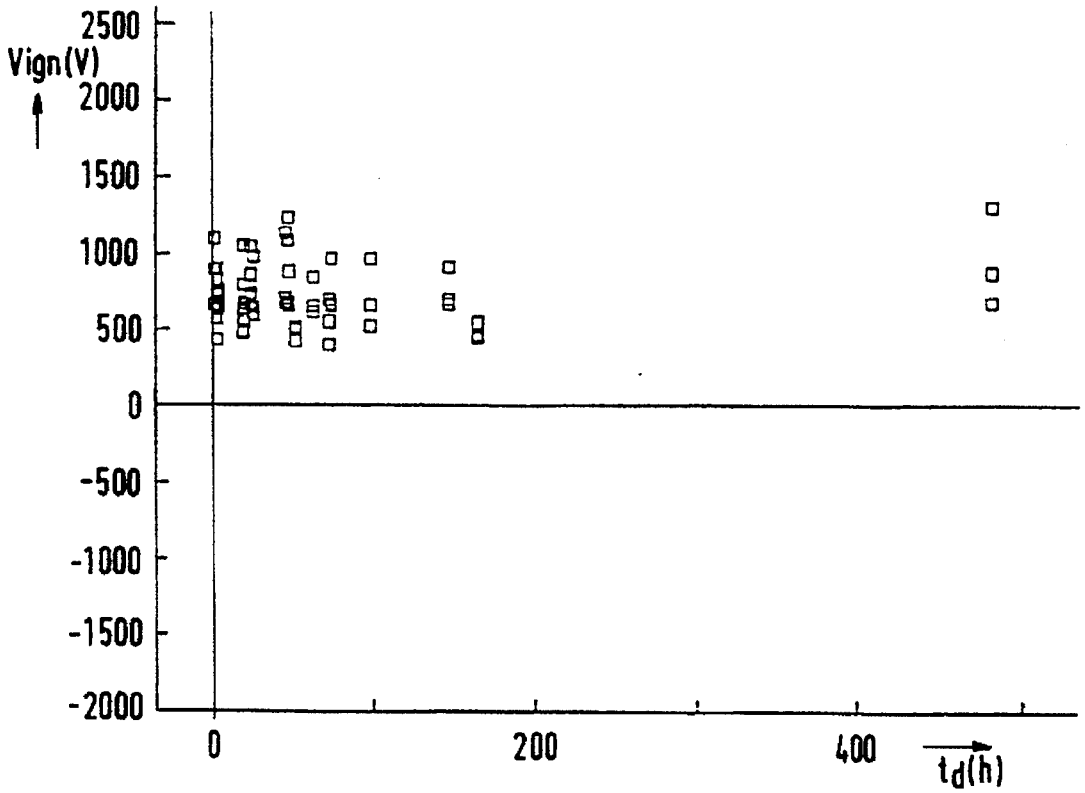
FIGS. 5 and 6 show results of measurements of the lamp according to the invention and the known lamp, respectively.

The measured ignition voltage ($V_{ign}$) as a function of the dark period ($t_d$) is shown in FIG. 5. It is apparent from this Figure that the lamp according to the invention ignites with a single ignition pulse of a voltage of between approximately 400 V and 1300 V also after this lamp has been out of operation for more than 400 hours.

Figure 6:
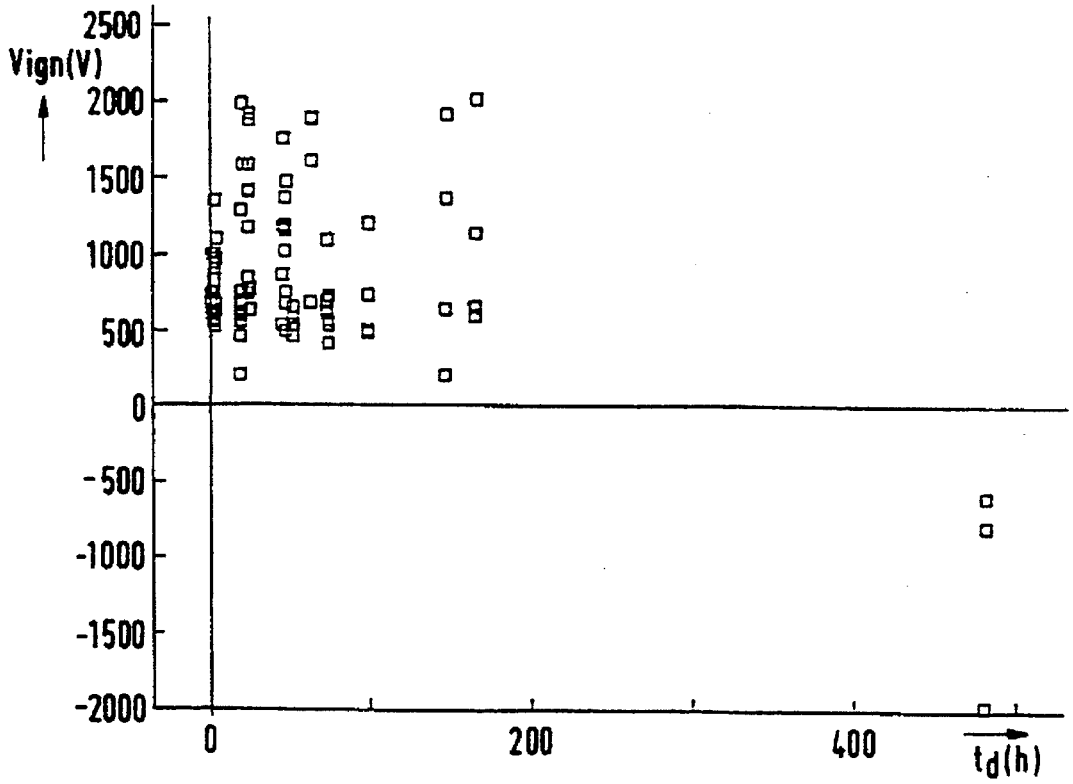

The ignition voltage ($V_{ign}$) was measured as a function of the dark period ($t_d$) in the same manner for the known lamp, whose recessed portion is provided with an uninterrupted layer of luminescent material. The ignition voltage ($V_{ign}$) of the known lamp lies between approximately 500 and approximately 2000 V (see FIG. 6) for a dark period ($t_d$) of up to 200 hours. For a dark period ($t_d$) longer than 400 hours, a single ignition pulse is insufficient in two out of three cases. In those cases, the measured point belonging to the first effective ignition pulse is depicted in the Figure only, this point being mirrored relative to the horizontal axis.

I claim:

1. A lighting unit comprising an electrodeless low-pressure discharge lamp provided with a discharge vessel which encloses a discharge space containing an ionizable filling in a gastight manner and which has a recessed portion and an enveloping portion which is permeable to radiation generated in the discharge vessel, while the recessed portion is provided with a luminescent layer at a surface facing towards the discharge space, and means are present in the recessed portion for achieving and maintaining an electric discharge in the discharge space, which means comprise a member for generating an electric field in the discharge space (21), and the lighting unit in addition has a electrical supply unit for supplying said means, characterized in that the luminescent layer on the recessed portion is subdivided into mutually separated regions.

2. A lighting unit as claimed in claim 1, characterized in that the means comprise a coil which is provided with a winding of an electrical conductor.

3. A lighting unit as claimed in claim 2, characterized in that the winding is a helix with a longitudinal axis, regions of the luminescent layer being arranged in the direction of said longitudinal axis.

4. A lighting unit as claimed in claim 3, characterized in that the member comprises a first and a second electrode each of which extend adjacent a respective region of the luminescent layer.

5. A lighting unit as claimed in claim 2, characterized in that the member comprises a first and a second electrode each of which extend adjacent a respective region of the luminescent layer.

6. A lighting unit as claimed in claim 2, characterized in that the coil comprises a winding curved in the shape of a torus portion whose ends, are directed at respective regions of the luminescent layer.

7. A lighting unit as claimed in claim 6, characterized in that the member comprises a first and a second electrode each of which extend adjacent a respective region of the luminescent layer.

8. A lighting unit as claimed in claim 1, characterized in that the member comprises a first and a second electrode each of which extend adjacent a respective region of the luminescent layer.

9. An electrodeless low-pressure discharge lamp, comprising: a discharge vessel which encloses a discharge space containing an ionizable filling in a gastight manner and which has a recessed portion and an enveloping portion which is permeable to radiation generated in the discharge vessel, while the recessed portion is provided with a luminescent layer at a surface facing towards the discharge space, and means are present in the recessed portion for achieving and maintaining an electric discharge in the discharge space, which means comprise a member for generating an electric field in the discharge space, characterized in that the luminescent layer on the recessed portion is subdivided into mutually separated regions.

10. A lighting unit as claimed in claim 9, characterized in that the means comprise a coil which is provided with a winding of an electrical conductor.

11. An electrodeless low pressure discharge lamp as claimed in claim 10, characterized in that the member comprises a first and a second electrode each of which extend adjacent a respective region of the luminescent layer.

12. An electrodeless low pressure discharge lamp as claimed in claim 9, characterized in that the winding is a helix with a longitudinal axis, regions of the luminescent layer being arranged in the direction of said longitudinal axis.

13. An electrodeless low pressure discharge lamp as claimed in claim 12, characterized in that the member comprises a first and a second electrode each of which extend adjacent a respective region of the luminescent layer.

14. An electrodeless low pressure discharge lamp as claimed in claim 9, characterized in that the coil comprises a winding curved in the shape of a torus portion whose ends are directed at respective regions of the luminescent layer.

15. An electrodeless low pressure discharge lamp as claimed in claim 14, characterized in that the member comprises a first and a second electrode each of which extend adjacent a respective region of the luminescent layer.

16. An electrodeless low pressure discharge lamp as claimed in claim 9, characterized in that the member comprises a first and a second electrode each of which extend each adjacent a respective region of the luminescent layer.

17. A discharge vessel, comprising a light transmissive wall which encloses a discharge space containing an ionizable filling in a gastight manner and which has a recessed portion and an enveloping portion which is permeable to radiation generated in the discharge vessel, while the recessed portion is provided with a luminescent layer at a surface facing towards the discharge space, characterized in that the luminescent layer on the recessed portion is subdivided into mutually separated regions.

* * * * *